US012344980B2

(12) United States Patent
Sieding et al.

(10) Patent No.: US 12,344,980 B2
(45) Date of Patent: Jul. 1, 2025

(54) METHOD FOR OPERATING AN AUTOMATIC WASHING MACHINE, AND AUTOMATIC WASHING MACHINE

(71) Applicant: Miele & Cie. KG, Gütersloh (DE)

(72) Inventors: Dirk Sieding, Lünen (DE); Rainer Bicker, Verl (DE); Magnus Kortenjann, Telgte (DE); Markus Drücker, Gütersloh (DE); Steffen Lasner, Borgholzhausen (DE); Benedikt Fechtel, Rheda-Wiedenbrück (DE); Marcel Zielke, Ennigerloh (DE)

(73) Assignee: MIELE & CIE. KG, Gütersloh (DE)

( * ) Notice: Subject to any disclaimer, the term of this patent is extended or adjusted under 35 U.S.C. 154(b) by 214 days.

(21) Appl. No.: 18/025,846

(22) PCT Filed: Aug. 31, 2021

(86) PCT No.: PCT/EP2021/073983
§ 371 (c)(1),
(2) Date: Mar. 10, 2023

(87) PCT Pub. No.: WO2022/053351
PCT Pub. Date: Mar. 17, 2022

(65) Prior Publication Data

US 2023/0349086 A1 Nov. 2, 2023

(30) Foreign Application Priority Data

Sep. 11, 2020 (DE) ..... 102020123724.3

(51) Int. Cl.
*D06F 33/32* (2020.01)
*D06F 39/40* (2024.01)
(Continued)

(52) U.S. Cl.
CPC ..... *D06F 33/32* (2020.02); *D06F 39/40* (2024.01); *D06F 2103/06* (2020.02);
(Continued)

(58) Field of Classification Search
None
See application file for complete search history.

(56) References Cited

U.S. PATENT DOCUMENTS 4,507,080 A * 3/1985 Freze ..... D06F 58/26 432/103
2011/0099732 A1 5/2011 Im et al.
(Continued)

FOREIGN PATENT DOCUMENTS

DE 102007041906 A1 3/2009
EP 1867773 A1 12/2007

OTHER PUBLICATIONS

International Search Report dated Nov. 23, 2021.

*Primary Examiner* — Spencer E. Bell
(74) *Attorney, Agent, or Firm* — Dickinson Wright PLLC

(57) ABSTRACT

A washing machine and a method for operating the washing machine having a suds container for receiving water, a rib-free drum, which is rotatably mounted in the suds container, for receiving laundry, a motor for driving the drum, and an open-loop or closed-loop control device, wherein the method has a pre-ironing phase (Vb) for pre-ironing of the laundry located in the drum, during which phase steam is conducted into the drum and the drum is moved by means of the motor into a right-left pendulum motion, the pendulum rhythm of which is controlled using open-loop or closed-loop control by means of the open-loop or closed-loop control device in such a way that the drum is at least intermittently untouched by the laundry.

10 Claims, 1 Drawing Sheet

(51) Int. Cl.

| | |
|---|---|
| ***D06F 103/06*** | (2020.01) |
| ***D06F 103/08*** | (2020.01) |
| ***D06F 105/40*** | (2020.01) |
| ***D06F 105/48*** | (2020.01) |

(52) U.S. Cl.
CPC ..... *D06F 2103/08* (2020.02); *D06F 2105/40* (2020.02); *D06F 2105/48* (2020.02)

(56) References Cited

U.S. PATENT DOCUMENTS

| | | | | |
|---|---|---|---|---|
| 2012/0174430 | A1* | 7/2012 | Kim | D06F 58/46 34/492 |
| 2020/0149205 | A1* | 5/2020 | Jeoung | D06F 37/04 |

* cited by examiner

METHOD FOR OPERATING AN AUTOMATIC WASHING MACHINE, AND AUTOMATIC WASHING MACHINE

RELATED APPLICATIONS

The present disclosure claims priority to and the benefit of PCT Application PCT/EP2021/073983, filed on Aug. 31, 2021, which claims priority to and the benefit of German Application 10 2020 123 724.3, filed on Sep. 11, 2020, the entire contents of both of which are incorporated herein by reference.

TECHNICAL FIELD

The disclosure relates to a method for operating a washing machine and to a washing machine. In particular, the disclosure relates to a method for operating a washing machine having a suds container for receiving water, a drum, which is rotatably mounted in the suds container, for receiving laundry, a motor for driving the drum and an open-loop or closed-loop control device, the method having a pre-ironing phase for pre-ironing of the laundry located in the drum, and to the corresponding washing machine. In the pre-ironing phase, the laundry is de-creased, with steam being applied to the laundry.

BACKGROUND

The pre-ironing phase ensures de-creasing of the laundry. After de-creasing, the degree of creasing of the de-creased laundry that is subjectively perceived by a user, i.e. of the laundry subjected to the pre-ironing phase, is significantly reduced in comparison with non-de-creased laundry, i.e. laundry which has not been subjected to the pre-ironing phase. However, this form of de-creasing is very energy-intensive, because the desired effect is only achieved by high temperatures and long exposure times.

One problem addressed by the disclosure is therefore that of providing a method for operating a washing machine, and a washing machine which minimises or prevents the degree of creasing of laundry with minimal energy expenditure.

SUMMARY

According to the disclosure, this problem is solved by a method having the features of claim 1 and by a washing machine having the features of claim 10. Advantageous embodiments and developments of the disclosure result from the subsequent dependent claims.

The advantages that can be achieved with the disclosure consist, in addition to preventing or minimising the formation of creased textiles in a washing process, in that this leads to a considerable simplification and minimisation of an ironing effort. When laundry is refreshed, the process is optimised such that the laundry can be worn again after a relatively short treatment time. The laundry is one or more textiles such as shirts or blouses.

The disclosure relates to a method for operating a washing machine having a suds container for receiving water, a rib-free drum rotatably mounted in the suds container, for receiving laundry, a motor for driving the drum, and an open-loop or closed-loop control device, wherein the method has a pre-ironing phase for the pre-ironing of the laundry located in the drum, during which steam is conducted into the drum and the drum is moved by means of the motor into a right-left pendulum motion, the pendulum rhythm of which is controlled using open-loop or closed-loop control by means of the open-loop or closed-loop control device in such a way that the drum is at least intermittently untouched by the laundry.

By introducing the pendulum cycle, it is possible to generate a rapid change in direction of the drum. As a result, laundry idle times in the drum can be minimised and the laundry can be put into a "floating" state. The laundry can comprise one or more textiles. The textile(s), such as one or more shirts, are set into aerial motion by the pendulum rhythm. The steam can flow through the laundry and the laundry can be held in suspension. The significantly reduced idle times or pauses prevent or reduce the formation of creases, which arise primarily due to long idle times. On account of the barrier-free drum, which is rib-free and has no drum paddles, a perfect laundry trajectory is ensured. The use of steam additionally prompts the decreasing of the laundry, such that the laundry is relaxed, so to speak, on a heated air flow. Due to the fact that the drum is rib-free, an effect leading to more creases, which is caused by the paddles usually present in the drum, is prevented. Instead, since the drum is designed without ribs or paddles, it is designed to be barrier-free to allow a floating state of the laundry in the drum.

A rib-free drum is a drum which has no ribs or paddles in its interior. However, it can have other elevations and/or depressions which do not have the shape of the planar rib or the paddle. The drum, preferably the drum casing, preferably comprises depressions and/or elevations that have a different design than that of a rip. The drum preferably has honeycombs which are each designed as an elevation or depression.

The pre-ironing phase can be implemented, for example, by means of a selectable "pre-iron" option, in which the laundry is post-treated after the wash programme is carried out to minimise the subsequent ironing effort. The "pre-iron" option is preferably stored in the washing machine and can be selected by the user together with a wash programme stored in the washing machine.

Alternatively or additionally, the pre-ironing phase can be implemented by means of a wash programme stored in a non-transitory computer readable medium in the washing machine, in which laundry is refreshed and de-creased in the dry state, such that the laundry can be worn again after the program has been carried out. Such a wash programme is, for example, stored in the washing machine with the designation "refresh" and can be selected by the user.

The expression "that the drum is at least intermittently untouched by the laundry" is preferably to be understood as meaning that the laundry does not touch the drum over a predetermined time, but is aerially suspended in the drum in a non-contacting manner. This prevents the laundry from resting on the drum. This floating state of the laundry is achieved in particular by the combination of the rib-free drum, the pendulum motion of the drum and the introduction of steam.

Preferably, the open-loop or closed-loop control device includes a processor or integrated circuit that controls the pendulum rhythm using open-loop or closed-loop control according to a type of laundry. The trajectory of the laundry is dependent on a laundry weight and thus also on a type of laundry. Relatively heavy laundry types, such as jeans, are preferably operated with a higher pendulum deflection than relatively light laundry types. This ensures that the items of laundry are always held in a certain floating state. If the user selects and starts a wash programme for washing the laundry in the drum, the open-loop or closed-loop control device can determine the type of laundry, for example, on the basis of the selected and started wash programme. For example, a type of laundry is assigned to each of the wash programmes stored in the washing machine. For example, the laundry type cotton is assigned to the wash programme "hot wash 60° C." or "cotton 90° C.", while the laundry type shirt and/or blouse is assigned to the wash programme "delicates wash 30° C.". Optionally, the open-loop or closed-loop control device can also request the user to input the type of laundry before starting the wash programme via a keyboard or a touch display and/or to select a type of laundry displayed by the washing machine.

In a preferred embodiment, the open-loop or closed-loop control device controls the pendulum rhythm using open-loop or closed-loop control in such a way that the pendulum rhythm varies depending on a time period. It is preferably taken into account in this case that the residual moisture in the laundry varies over the time period. For example, the variation of the residual moisture can have been determined over the time period on the basis of model experiments, such that a predetermined variation of the pendulum rhythm over the time period is stored in the open-loop or closed-loop control device.

Preferably, the open-loop or closed-loop control device controls the pendulum rhythm using open-loop or closed-loop control depending on a residual moisture in the laundry. The trajectory of the laundry depends on the residual moisture and the pendulum rhythm is adapted to the residual moisture in order to achieve an optimal trajectory. The steaming causes the laundry to become heavier over the course of the pre-ironing phase, and the residual moisture in the laundry increases. This increase in weight preferably affects the deflection of the pendulum rhythms.

In a preferred embodiment, the open-loop or closed-loop control device controls the pendulum rhythm using open-loop or closed-loop control in such a way that a pendulum deflection of the pendulum rhythm is greater the heavier a type of laundry. As a result, the trajectory of the laundry is further optimised, the type of laundry and its weight, which depends on the type, being taken into account.

Alternatively or additionally, the open-loop or closed-loop control device controls the pendulum rhythm using open-loop or closed-loop control in such a way that a pendulum deflection of the pendulum rhythm is greater the longer the time period. Alternatively or additionally, the open-loop or closed-loop control device controls the pendulum rhythm using open-loop or closed-loop control in such a way that a pendulum deflection of the pendulum rhythm is greater the greater residual moisture in the laundry. This further ensures that the laundry is always held in a predetermined floating state. The residual moisture rises during the pre-ironing phase and over the time period due to the steaming of the laundry, which therefore becomes heavier and heavier.

The open-loop or closed-loop control device preferably determines the residual moisture as a function of time. This increase is generally linear and dependent on the type of laundry.

In a preferred embodiment, the steam is conducted into the drum from below, in relation to an operational installation position of the washing machine. As a result, the warm air flowing up from below flows through the laundry and continues to support the floating state of the laundry in the drum.

Preferably, the open-loop or closed-loop control device controls a maximum pendulum deflection of the pendulum rhythm using open-loop or closed-loop control according to a maximum rotational speed of the drum at which the drum is rotated at the maximum during the pre-ironing phase. The maximum rotational speed is preferably in the range from 60 to 120 min−1.

A relatively high temperature of the steam is not necessary, in particular for textiles with a high proportion of synthetics; the creasing of the laundry is already largely reduced by the pendulum rhythm. The unordered fibre state, or the presence of creases, is brought back into the ordered initial state by the aerial suspension of the laundry in the drum during the pre-ironing phase. It has been found that a steam temperature of <50° C. is sufficient to de-crease the laundry. Preferably, a temperature of the steam is <50° C. during the pre-ironing phase. This relatively low temperature does not lead to condensation on a door-mounted inspection glass of the washing machine in the case of a front loader with door-mounted inspection glass. This is advantageous in particular for dry laundry subjected to refreshing because no water spots then form on it. Furthermore, a low energy consumption for steaming the laundry during the pre-ironing phase is required.

To generate the steam, a steam module can be used, for example. Alternatively, the steam can be generated by means of a heating element which is arranged below the drum and designed to generate steam during the pre-ironing phase using an immersion heater principle. This is carried out, for example, by accordingly controlling a water level in the suds container using open-loop or closed-loop control during the pre-ironing phase.

The disclosure further relates to a washing machine having a suds container for receiving water, a rib-free drum, which is rotatably mounted in the suds container, for receiving laundry, a motor for driving the drum and an open-loop or closed-loop control device which is designed and configured to control a method using open-loop or closed-loop control according to one or more of the previously described embodiments.

The washing machine can be designed as a washing machine or as a combined appliance such as a washer-dryer. Preferred embodiments and advantages described for the method apply accordingly to the washing machine.

BRIEF DESCRIPTION OF THE DRAWINGS

An embodiment of the disclosure is shown purely schematically in the drawings and is described in more detail below. In the drawings.

DETAILED DESCRIPTION OF THE DRAWINGS

Figure 1:
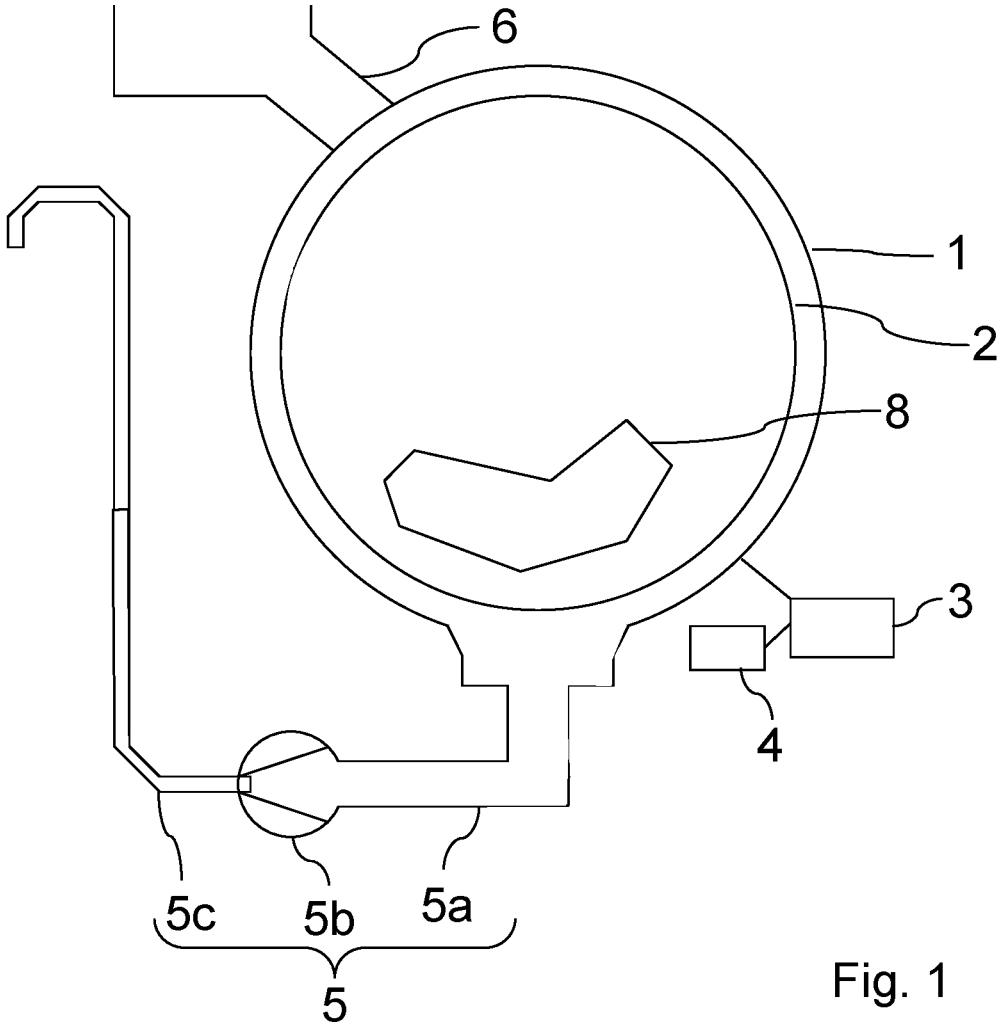
FIG. 1 shows a partial cross-sectional view of a washing machine according to the disclosure.

FIG. 1 shows a partial cross-sectional view of a washing machine according to the disclosure. The washing machine has a suds container 1 for receiving water (not shown), a rib-free drum 2, which is rotatably mounted in the suds container 1, for receiving laundry 8, and a motor 3 for driving the drum 2. The washing machine further comprises a dispensing compartment 6, which may optionally contain a treatment agent such as washing powder and which is connected to the suds container 1 such that water can be introduced into the suds container 1 and into the drum 2 via the suds container. The drum 2 has a plurality of drum openings (not shown) for magnetomotive force. Furthermore, the washing machine has a drainage device 5 in order to be able to remove the water 7 from the suds container 1. The drainage device 5 has a drainage pipe 5*a* which connects the suds container 1 to a drainage pump 5*b*, which in turn is connected to a drainage line 5*c*, which generally opens into a wastewater channel. The washing machine further comprises an open-loop or closed-loop control device 4 which is designed to control the motor 3, a water inlet, a water outlet, and carrying out a wash programme and the like using open-loop or closed-loop control.

Figure 2:
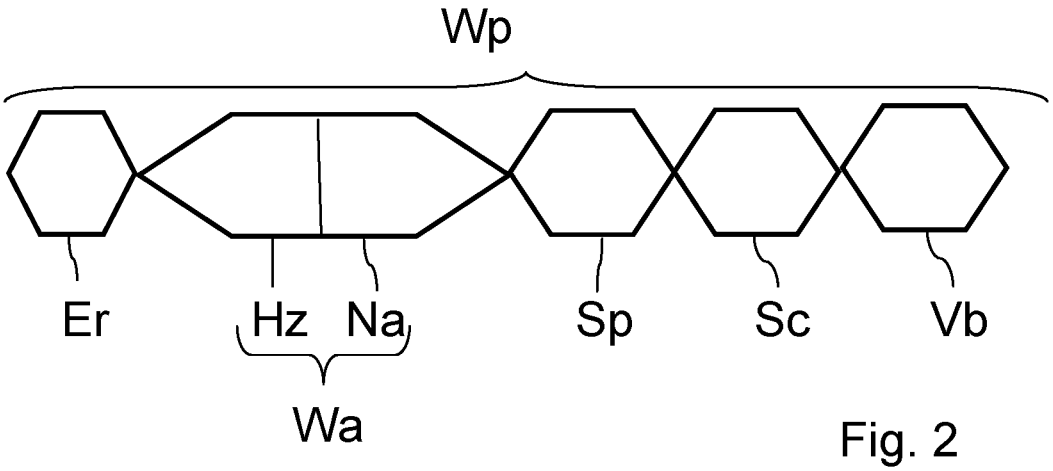
FIG. 2 shows a wash programme stored in the washing machine shown in FIG. 1 as a diagram in time sequence.

During operation of the washing machine, a wash programme shown in FIG. 2 is carried out for example for washing and de-creasing laundry 8 located in the drum 2. Alternatively, the laundry 8 for de-creasing can also be treated using a wash programme in which the dry laundry 8 placed in the drum 2 by the user is steamed by conducting steam into the drum and in which the drum 2 is moved by means of the motor 3 into a right-left pendulum motion, the pendulum rhythm of which is controlled using open-loop or closed-loop control by means of the open-loop or closed-loop control device 4 in such a way that the drum 2 is at least intermittently untouched by the laundry 8.

FIG. 2 shows a wash programme stored in the washing machine shown in FIG. 1 as a diagram in time sequence. The individual phases within the wash programme Wp are shown on the time axis t. The program sequence Wp shown here comprises a detection phase Er, a washing phase Wa, a rinsing phase Sp, a spinning phase Sc and a pre-ironing phase Vb. At the beginning of the wash programme Wp, the laundry batch is detected in the detection phase Er, in which a loading quantity of laundry in the drum is detected. Thereafter, water is admitted via the dispensing compartment, whereby a treatment agent optionally stored therein, such as washing powder, is admitted into the suds container. This is followed, in the washing phase Wa, by a heating portion Hz, in which the water is heated by means of an activated heating element of the washing machine to a temperature which is specified by the open-loop or closed-loop control device from the selected wash programme Wp. After reaching the specified temperature, the heating element is switched off and a so-called post-wash portion Na follows. In this post-wash portion Na, the laundry is moved by means of rotating drum, and the water cools down.

The washing phase Wa is ended with the pumping out, in which the drainage device, in particular the drainage pump, is activated. During pumping out, it is also possible to perform a spin cycle so that the water admixed with the treatment agent is removed from the laundry. This is then followed by the rinsing phase Sp, in which water is again admitted into the suds container and the laundry is moved therein in order to rinse the laundry. At the end of the rinsing phase Sp, the rinsing water is pumped out, followed by the final spin Sc for draining the laundry. During the final spin Sc, the drum is rotated with an increased rotational speed compared with the washing process, in which the laundry rests on the drum casing and the water is spun out from the laundry through the drum openings due to the centrifugal force. The drainage device is activated in this case, so that the water is removed from the suds container. In the pre-ironing phase Vb, steam is conducted into the drum and the drum is moved by means of the motor into a right-left pendulum motion, the pendulum rhythm of which is controlled using open-loop or closed-loop control by means of the open-loop or closed-loop control device in such a way that the drum is at least intermittently untouched by the laundry. This causes the laundry to de-crease.

LIST OF REFERENCE SIGNS

Er Detection phase
Hz Heating phase
Na Post-wash phase
Sc Spinning phase
Sp Rinsing phase
Vb Pre-ironing phase
Wa Washing phase
Wp Wash programme
1 Suds container
2 Drum
3 Motor
4 Control device for open-loop or closed-loop control
5 Drainage system
5*a* Drainage pipe
5*b* Drainage pump
5*c* Drainage line
6 Dispensing compartment
8 Laundry

The invention claimed is:

1. A method for operating a washing machine having a suds container for receiving water, a rib-free drum, which is rotatably mounted in the suds container, for receiving laundry, a motor for driving the drum, and an open-loop or closed-loop control device, wherein the method has a pre-ironing phase (Vb) for pre-ironing of the laundry located in the drum, during which phase steam is conducted into the drum and the drum is moved by means of the motor into a right-left pendulum motion, the pendulum rhythm of which is controlled using open-loop or closed-loop control by means of the open-loop or closed-loop control device in such a way that the drum is at least intermittently untouched by the laundry.

2. The method according to claim 1, wherein the open-loop or closed-loop control device controls the pendulum rhythm depending on the type of laundry.

3. The method according to claim 1, wherein the open-loop or closed-loop control device controls the pendulum rhythm using open-loop or closed-loop control in such a way that the pendulum rhythm varies depending on a time period.

4. The method according to claim 1, wherein the open-loop or closed-loop control device controls the pendulum rhythm depending on a residual moisture in the laundry.

5. The method according to claim 2, wherein the open-loop or closed-loop control device controls the pendulum rhythm using open-loop or closed-loop control in such a way that a pendulum deflection of the pendulum rhythm is greater the heavier the type of laundry and/or the longer a time period and/or the greater a residual moisture content.

6. The method according to claim 4, wherein the open-loop or closed-loop control device determines the residual moisture as a function of time.

7. The method according to claim 1, wherein the steam is conducted into the drum from below, based on an operational installation position of the washing machine.

8. The method according to claim 1, wherein the open-loop or closed-loop control device controls a maximum pendulum deflection of the pendulum rhythm depending on a maximum rotational speed of the drum at which the drum is rotated at the maximum during the pre-ironing phase (Vb).

9. The method according to claim 1, wherein a temperature of the steam is <50° C.

10. A washing machine having a suds container for receiving water, a rib-free drum, which is rotatably mounted in the suds container, for receiving laundry, a motor for driving the drum and an open-loop or closed-loop control device which is designed and configured to control a method using open-loop or closed-loop control according to claim 1.

* * * * *